US009496106B2

(12) United States Patent
Ryu

(10) Patent No.: US 9,496,106 B2
(45) Date of Patent: Nov. 15, 2016

(54) ELECTRODE ASSEMBLY AND VACUUM INTERRUPTER INCLUDING THE SAME

(71) Applicant: LSIS CO., LTD., Anyang-si, Gyeonggi-do (KR)

(72) Inventor: Jae Seop Ryu, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/339,246

(22) Filed: Jul. 23, 2014

(65) Prior Publication Data

US 2015/0069019 A1 Mar. 12, 2015

(30) Foreign Application Priority Data

Sep. 12, 2013 (KR) ..... 10-2013-0109943

(51) Int. Cl.
*H01H 33/664* (2006.01)

(52) U.S. Cl.
CPC ..... *H01H 33/6641* (2013.01); *H01H 33/6644* (2013.01); *H01H 2205/002* (2013.01); *H01H 2239/044* (2013.01)

(58) Field of Classification Search
CPC ..... H01H 33/66; H01H 33/664; H01H 33/6641–33/6646
USPC ..... 218/123–124, 127, 129–130, 118, 121
See application file for complete search history.

(56) References Cited

U.S. PATENT DOCUMENTS 5,777,287 A * 7/1998 Mayo ..... H01H 33/6642 218/123
5,804,788 A * 9/1998 Smith ..... H01H 33/6644 218/129
6,163,002 A * 12/2000 Ahn ..... H01H 33/6643 218/123

(Continued)

FOREIGN PATENT DOCUMENTS

CN 101834086 A 9/2010
CN 102842455 A 12/2012

(Continued)

OTHER PUBLICATIONS

Machine translation KR1020080067771 (Org. doc. published Jan. 22, 2010).*

(Continued)

*Primary Examiner* — Renee Luebke
*Assistant Examiner* — William Bolton
(74) *Attorney, Agent, or Firm* — Lee, Hong, Degerman, Kang & Waimey

(57) ABSTRACT

Disclosed are an electrode assembly and a vacuum interrupter including the same. The electrode assembly is provided in an insulating vessel which is in a vacuum state, and switches a main circuit. The electrode assembly includes a first electrode plate, a second electrode, a coil conductor, a first conductor, and a second conductor. The coil conductor induces a flow of a current in a first direction and a second direction between the other side of the first conductor connecting pin and the one side of the second conductor connecting pin, and the first direction and the second direc- (Continued)

tion are mutually opposite circumference directions. Accordingly, an arc gas is effectively spread by using mutually opposite flows of currents in a circumference direction, thereby enhancing break performance.

20 Claims, 8 Drawing Sheets

(56) References Cited

U.S. PATENT DOCUMENTS

| | | | | |
|---|---|---|---|---|
| 2002/0043514 | A1* | 4/2002 | Kim, II ..... | H01H 33/6644 218/118 |
| 2010/0230388 | A1 | 9/2010 | Tak et al. | |

FOREIGN PATENT DOCUMENTS

| | | |
|---|---|---|
| DE | 19707778 | 9/1998 |
| DE | 19851964 | 5/2000 |
| EP | 2538428 | 12/2012 |
| JP | 05-190062 | 7/1993 |
| JP | 07-249352 | 9/1995 |
| KR | 10-2010-0007232 | 1/2010 |
| KR | 2010-0102485 | 9/2010 |

OTHER PUBLICATIONS

Machine translation DE19707778 (Org. doc. published Sep. 3, 1998).*

Korean Intellectual Property Office Application Serial No. 10-2013-0109943, Office Action dated Jun. 3, 2014, 4 pages.

Korean Intellectual Property Office Application Serial No. 10-2013-0109943, Notice of Allowance dated Dec. 24, 2014, 2 pages.

Fenski, et al., "Characteristics of a Vacuum Switching Contact Based on Bipolar Axial Magnetic Field," IEEE Transactions on Plasma Science, vol. 27, No. 4, Aug. 1999, XP011045328, pp. 949-953.

European Patent Office Application Serial No. 14179335.6, Search Report dated Feb. 19, 2015, 8 pages.

State Intellectual Property Office of the People's Republic of China Application Serial No. 201410465552.X, Office Action dated Feb. 1, 2016, 6 pages.

* cited by examiner

ELECTRODE ASSEMBLY AND VACUUM INTERRUPTER INCLUDING THE SAME

CROSS-REFERENCE TO RELATED APPLICATION

Pursuant to 35 U.S.C. §119(a), this application claims the benefit of earlier filing date and right of priority to Korean Application No. 10-2013-0109943, filed on Sep. 12, 2013, the contents of which are all hereby incorporated by reference herein in its entirety.

BACKGROUND OF THE DISCLOSURE

1. Field of the Disclosure

The present disclosure relates to a vacuum interrupter for enhancing arc extinction and break performance.

2. Background of the Disclosure

Generally, a vacuum circuit breaker is a type of circuit breaker that is provided in a high-voltage power system, and when a risk condition such as short circuit or an overcurrent occurs, breaks a circuit to protect the power system. The vacuum circuit breaker is designed to have excellent insulation performance and arc extinction capability in a vacuum state.

The vacuum circuit breaker includes a vacuum interrupter as an essential element. The vacuum interrupter includes a fixing electrode, which performs an electricity conducting function and break function of a circuit in a sealed vacuum tube, and a movable electrode which may contact the fixed electrode or may be separated from the fixed electrode. In particular, a portion at which the fixed electrode directly contacts the movable is referred to as a contact. A high current flows in a contact of a circuit. When a flat contact in which any design is not reflected in a contact is used, a high-temperature arc is contracted by contact separation, and is fixed to the center of the float contact. This is referred to as a pinch effect. In order to prevent the pinch effect, an axial magnetic field and a radial magnetic field have been proposed as a contact shape. The axial magnetic field uses a method that immediately spread arcs to prevent the arc from being contracted, and the radial magnetic field uses a method that allows an arc to be contracted but rotates the arc to disperse arc energy.

A vacuum interrupter using the axial magnetic field has an axial magnetic electrode structure, which rotates a current in a circumference direction of an electrode to generate a magnetic flux in an axial direction, between a fixed electrode and a movable electrode. The axial-direction magnetic flux spread arcs, which are generated between electrodes, to a whole surface of an electrode contact surface, and thus prevents an electrode surface from being damaged by a concentration of arcs and enables a current to be cut off.

The axial magnetic structure is categorized into a coil type electrode structure illustrated in FIG. 1 and a cup type electrode structure illustrated in FIG. 2. In the coil type electrode structure of FIG. 1, a current conducting path of an electrode is formed in a coil shape, and an axial-direction magnetic flux is generated in an electrode surface. In the cup type electrode structure of FIG. 2, an inclined slit is provided in a cup-shaped hollow conductor, and an axial-direction magnetic flux is generated by flowing a current through the slit.

An example of FIG. 1, a current flowing into an electrode supporting plate 3 generates a current I which rotates in a circumference direction through a plurality of coil electrodes 1 and 2 connected to a plurality of lower conductor connection pins 4 and 6. The current I flows to a contact electrode (not shown) through a plurality of upper conductor connection pins 5 and 7, and then flows to another electrode facing the contact electrode. Here, a magnetic field is generated in an axial direction with the current I which flows in the coil electrodes 1 and 2.

An example of FIG. 2, a plurality of slits 12 are formed in a diagonal direction in a cup-shaped conductor 11, and thus, an electricity conducting path 13 through which a current flows is formed. A current I flowing through the electricity conducting path 13 flows to another facing electrode through a contact (not shown). Here, an axial-direction magnetic field is generated with the current I which flows through the electricity conducting path 13.

In directions of the currents respectively illustrated in FIGS. 1 and 2, the currents flow in the same direction or a single direction, and thus, as illustrated in FIG. 3, an axial-direction magnetic flux B generated between a fixed electrode 31 and a movable electrode 32 is generated in a single direction. FIG. 3 illustrates a distribution of unidirectional magnetic flux densities.

FIG. 4 is a plan view illustrating an example of a contact electrode used in the coil type electrode structure of FIG. 1. An intensity of the magnetic flux which is generated in the axial direction is changed depending on a change in a current, and the change in the magnetic flux generates an eddy current 42 in a surface of a contact electrode 40. The eddy current 42 causes a phase difference between a current and a magnetic flux, and a remaining magnetic flux is generated at a current zero, thereby affecting arc extinction.

As illustrated in FIG. 4, four slits 41 are formed in a contact electrode 40 in which a unidirectional axial magnetic field is formed, for preventing the eddy current 40 from being generated.

However, in a prior art coil type axial magnetic field electrode structure, since the number (for example, four) of the slits 41 formed in the contact electrode 40 is excessive, a process time is extended, and the manufacturing cost increases.

Moreover, dielectric strength is reduced due to a local concentration of an electric field caused by a shape of a slit.

SUMMARY OF THE DISCLOSURE

Therefore, an aspect of the detailed description is to provide a vacuum interrupter in which extinction performance is enhanced by the spread of arcs, and a shape of a contact electrode is simply formed, thereby shortening a process time and reducing the manufacturing cost.

An aspect of the detailed description is to provide a vacuum interrupter which decreases the number of regions where a local concentration of an electric field caused by processing of a slit occurs, thereby enhancing dielectric strength.

To achieve these and other advantages and in accordance with the purpose of this specification, as embodied and broadly described herein, a vacuum interrupter includes an insulating vessel, an internal shield, a fixed electrode assembly, and a movable electrode assembly.

The insulating vessel may be a cylindrical vessel that includes an accommodating space formed therein.

The internal shield may be provided at an inner surface of the insulating vessel, and configured to shield an arc gas which is generated in the insulating vessel.

The fixed electrode assembly may be supported by a fixing shaft to be fixed to one side of the insulating vessel.

The movable electrode assembly may be movably supported by a movable shaft and at the other side of the insulating vessel.

The fixed electrode assembly or the movable electrode assembly may include a first electrode plate, a second electrode plate, a coil conductor, a first conductor connecting pin, and a second conductor connecting pin.

The first electrode plate may be connected to one end of a fixing shaft or a movable shaft.

The second electrode plate may be disposed to be separated from the first electrode plate in an axial direction.

The coil conductor may be disposed between the first electrode plate and the second electrode plate in a one-body ring shape.

The first conductor connecting pin may be connected to the first electrode plate at one side of the first conductor connecting pin, connected to the coil conductor at the other side of the first conductor connecting pin, and configured to provide an electricity conducting path.

The second conductor connecting pin may be connected to the coil conductor at one side of the second conductor connecting pin, connected to the second electrode plate at the other side of the second conductor connecting pin, and configured to provide an electricity conducting path.

The coil conductor may induce a flow of a current in a first direction and a second direction between the other side of the first conductor connecting pin and the one side of the second conductor connecting pin.

The first direction and the second direction may be mutually opposite circumference directions.

Therefore, according to an embodiment of the present invention, mutually opposite flows of currents in a circumference direction may generate opposite axial magnetic fields, and thus, arcs which are generated in a pillar shape between two electrode plates in separation can be effectively spread.

The electrode assembly may include a first supporting pin and a second supporting pin.

The first supporting pin may be connected to the first electrode plate at one side of the first supporting pin, connected to the coil conductor at the other side of the first supporting pin, and configured to maintain a certain gap between the first electrode plate and the coil conductor.

The second supporting pin may be connected to the coil conductor at one side of the second supporting pin, connected to the second electrode plate at the other side of the second supporting pin, and configured to maintain a certain gap between the second electrode plate and the coil conductor.

The first electrode plate may include a slit formed in a radius direction which crosses a flow of a current in a circumference direction.

The slit may be formed in a straight line at both sides of the first electrode plate.

The second electrode plate may include a slit formed in a direction which crosses a flow of a current in a circumference direction.

The slit may be formed in a straight line at both sides of the second electrode plate.

The first conductor connecting pin and the second conductor connecting pin may be formed of a material having relatively higher conductivity than the first supporting pin and the second supporting pin.

A current flowing in the coil conductor may be divided into two currents at the other side of the first connecting pin, and the two currents may respectively flow in a first direction and a second direction and join each other at the one side of the second conductor connecting pin, thereby generating a bidirectional axial magnetic field.

One selected from the first conductor connecting pin, the second conductor connecting pin, the first supporting pin, and the second supporting pin may include a discal body and a supporting axial part formed to protrude in an axial direction from a central portion of the discal body.

The first electrode plate or the second electrode plate may be formed in a discal shape.

As described above, in the vacuum interrupter according to the embodiments of the present invention, the bidirectional axial magnetic field is generated, and thus, the coil conductor is configured with one element. Accordingly, the electrode assembly structure is simplified in comparison with the prior art vacuum interrupter having a unidirectional axial magnetic electrode structure. Also, the number of the slits formed in the contact electrode is reduced, and thus, a process time and the cost are reduced.

Moreover, in comparison with the prior art unidirectional axial magnetic field, an effective cross-sectional area which affects the spread of arcs is enlarged, and thus, break performance can be enhanced. Also, the number of regions where a local concentration of an electric field caused by processing of a slit occurs is reduced, thereby enhancing dielectric strength.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
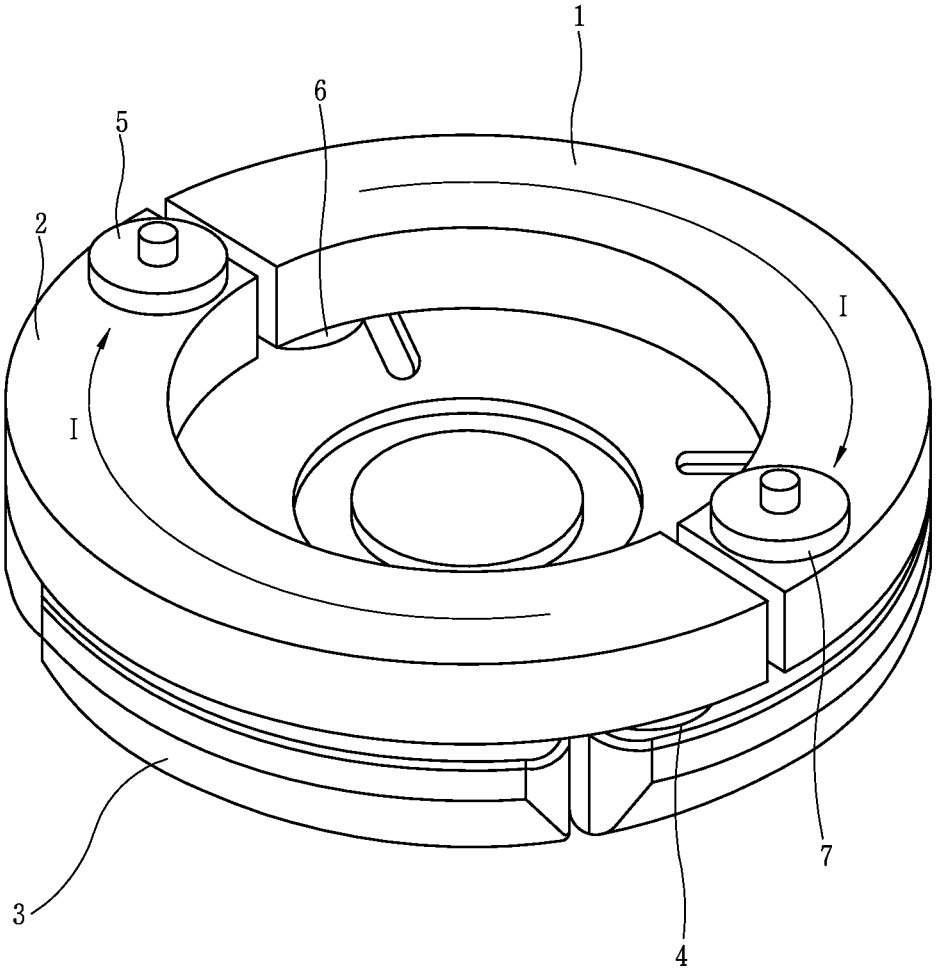
FIG. 1 PRIOR ART
FIG. 1 is a perspective view schematically illustrating a prior art coil type electrode structure.
Figure 2:
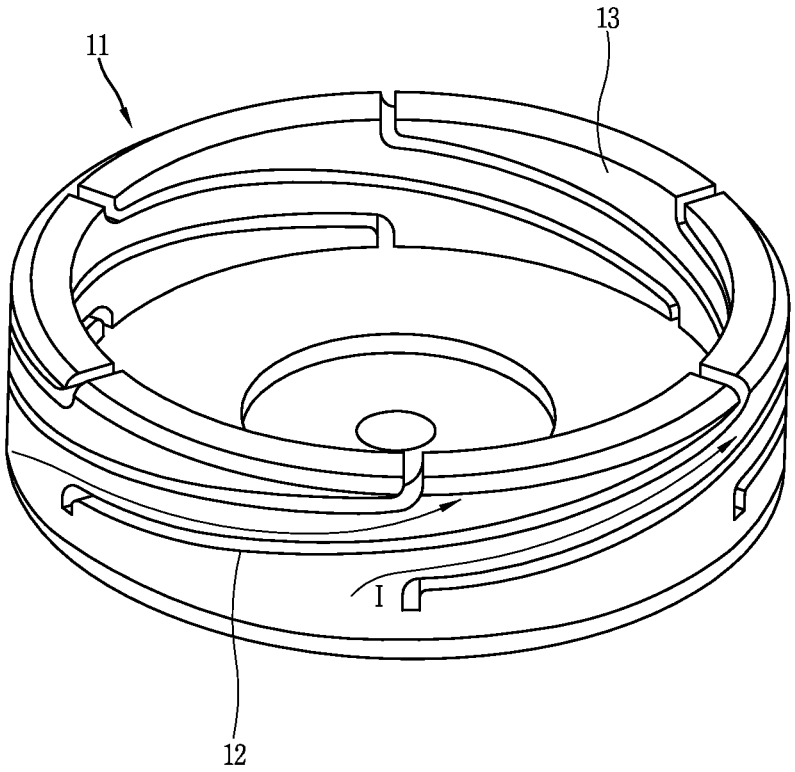
FIG. 2 PRIOR ART
FIG. 2 is a perspective view schematically illustrating a prior art cup type electrode structure.
Figure 3:
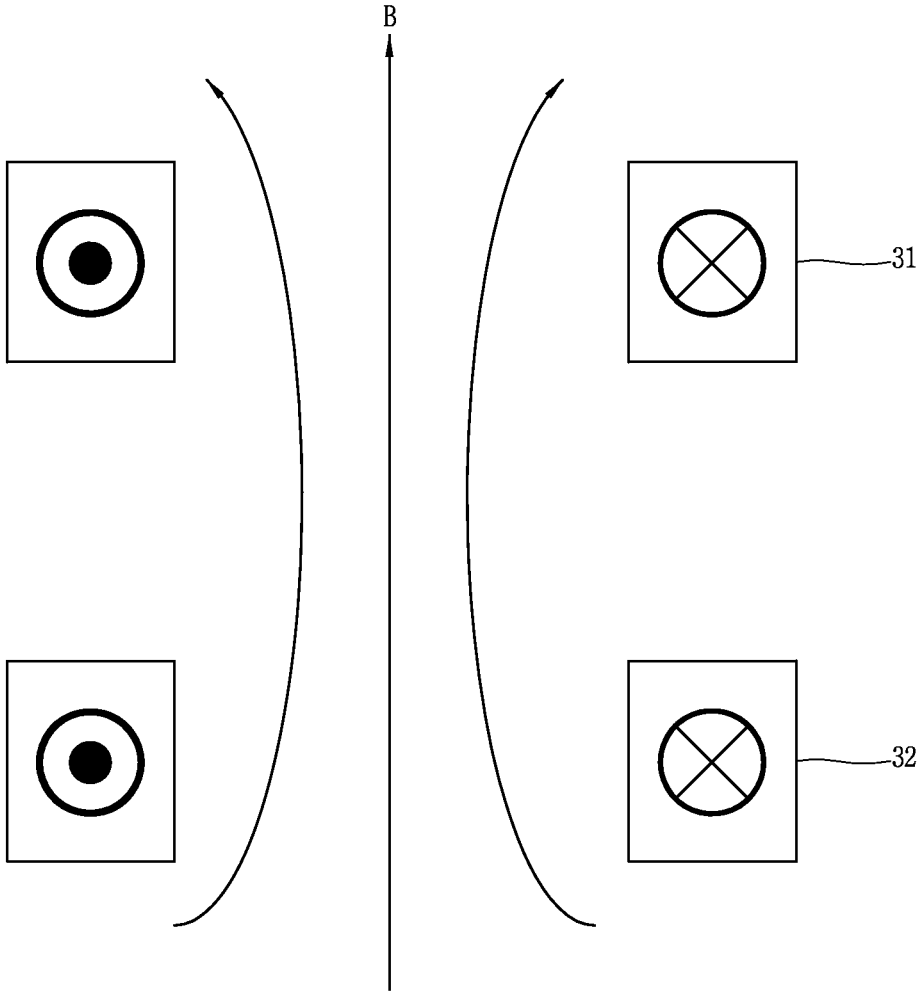
FIG. 3 PRIOR ART
FIG. 3 is a side view schematically illustrating a distribution of unidirectional magnetic flux densities.
Figure 4:
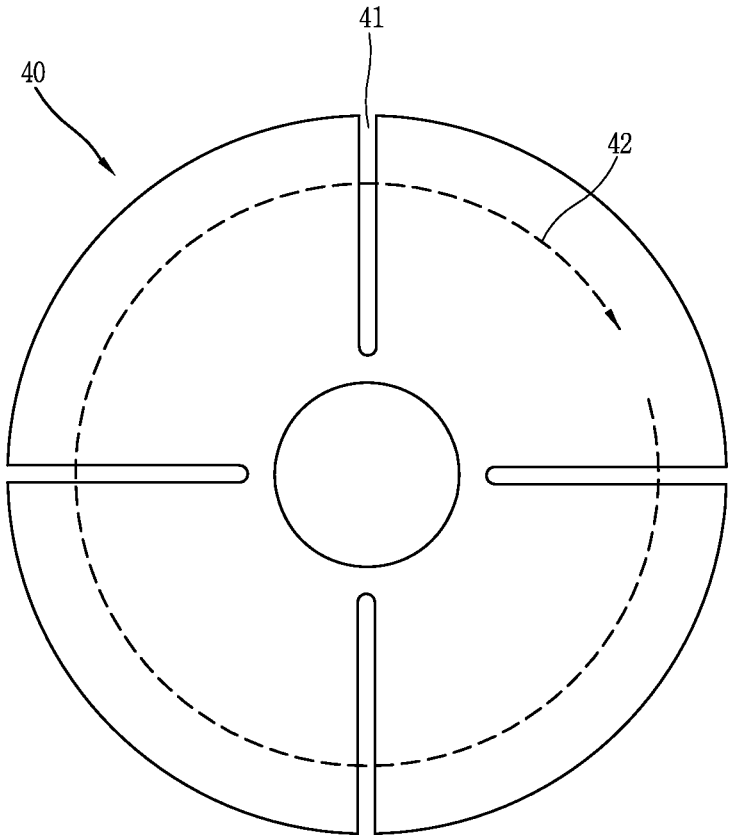
FIG. 4 PRIOR ART
FIG. 4 is a plan view illustrating an example of a contact electrode used in the coil type electrode structure of FIG. 1.
Figure 5:
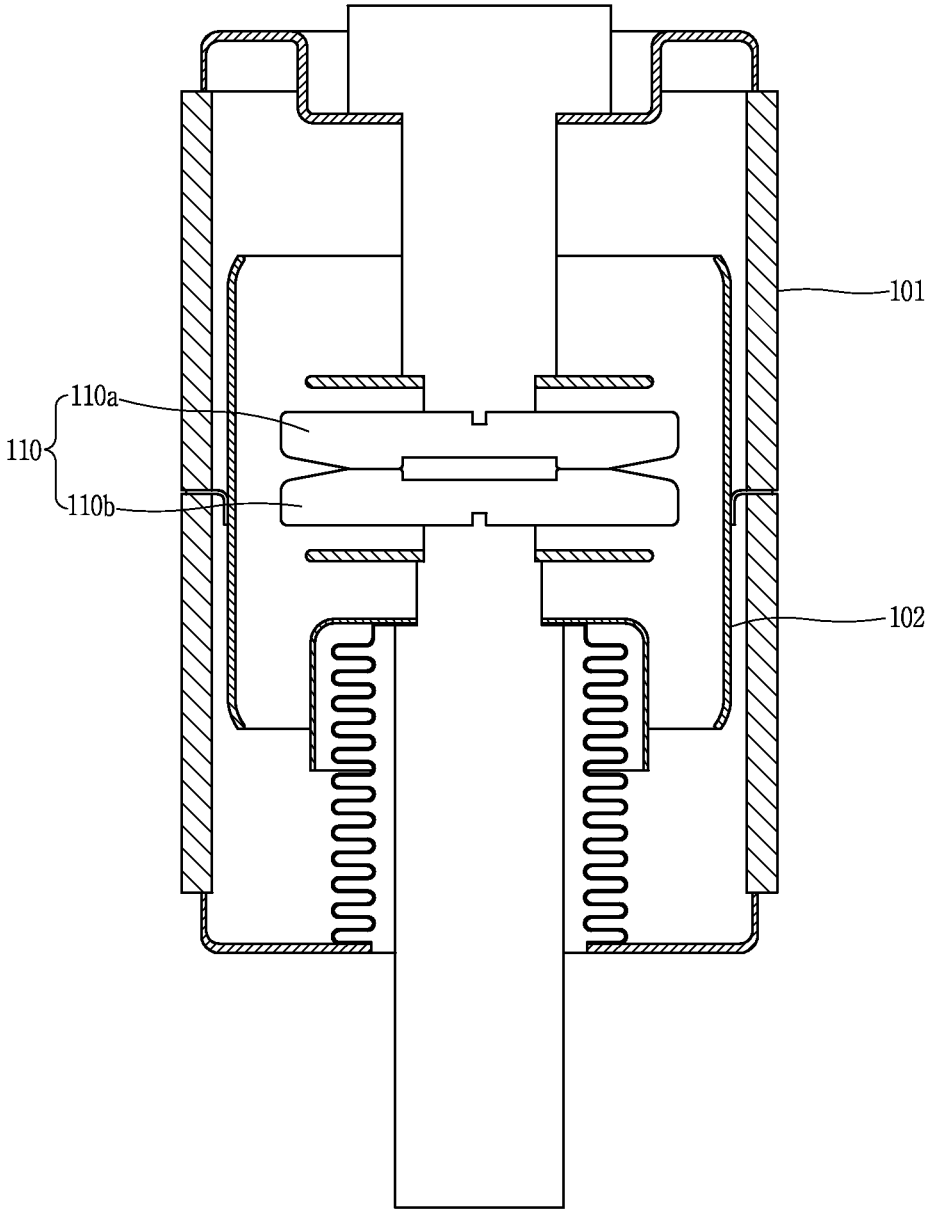
FIG. 5 is a cross-sectional view illustrating a vacuum interrupter according to an embodiment of the present invention.

FIG. 5 is a cross-sectional view illustrating a vacuum interrupter according to an embodiment of the present invention.

The vacuum interrupter according to an embodiment of the present invention generates a bidirectional axial magnetic field to secure a wide effective area which enables the spread of arcs to be effective, thereby enhancing arc extinction performance. Also, according to an embodiment of the present invention, a structure of an electrode is simplified, and thus, a process time and the cost can be reduced.

The vacuum interrupter according to an embodiment of the present invention may include an insulating vessel 101, an internal shield 102, a fixed electrode assembly 110*a*, and a movable electrode assembly 110*b*.

The insulating vessel 101 may be formed of an insulating material such as ceramic, and forms an external appearance of the vacuum interrupter. The insulating vessel 101 may be formed in a cylindrical shape where an accommodating space is formed in the inside. Also, openings respectively formed at an upper end and lower end of the insulating vessel 101 may be respectively sealed by an upper seal cap and a lower seal cap, and thus, the inside of the insulating vessel 101 may be maintained in a vacuum state.

The internal shield 102 may be a shielding member that covers an inner surface of the insulating vessel 101 to protect the insulating vessel 101 from an arc which is caused by contact separation. The internal shield 102 may be supported by a supporting member which is provided in the insulating vessel 101.

The fixed electrode assembly 110*a* and the movable electrode assembly 110*b* may be disposed in the insulating vessel 101 to be opposite to each other in a length direction (an axial direction) of the insulating vessel 101. The fixed electrode assembly 110*a* may be fixed to and provided at one side of the insulating vessel 101 by a fixing shaft, and the movable electrode assembly 110*b* may be movably provided in an axial direction at the other side of the insulating vessel 101 by a movable shaft. The electrode assemblies 110 may be formed of a conductive material. When the electrode assemblies 110 contact each other, a current flows, and when the electrode assemblies 110 are separated from each other, the current is cut off.

In this case, the fixed electrode assembly 110*a* and the movable electrode assembly 110*b* may have the same structure. Hereinafter, therefore, the fixed electrode assembly 110*a* and the movable electrode assembly 110*b* is referred to as an electrode assembly 110 as a generic name.

Figure 6:
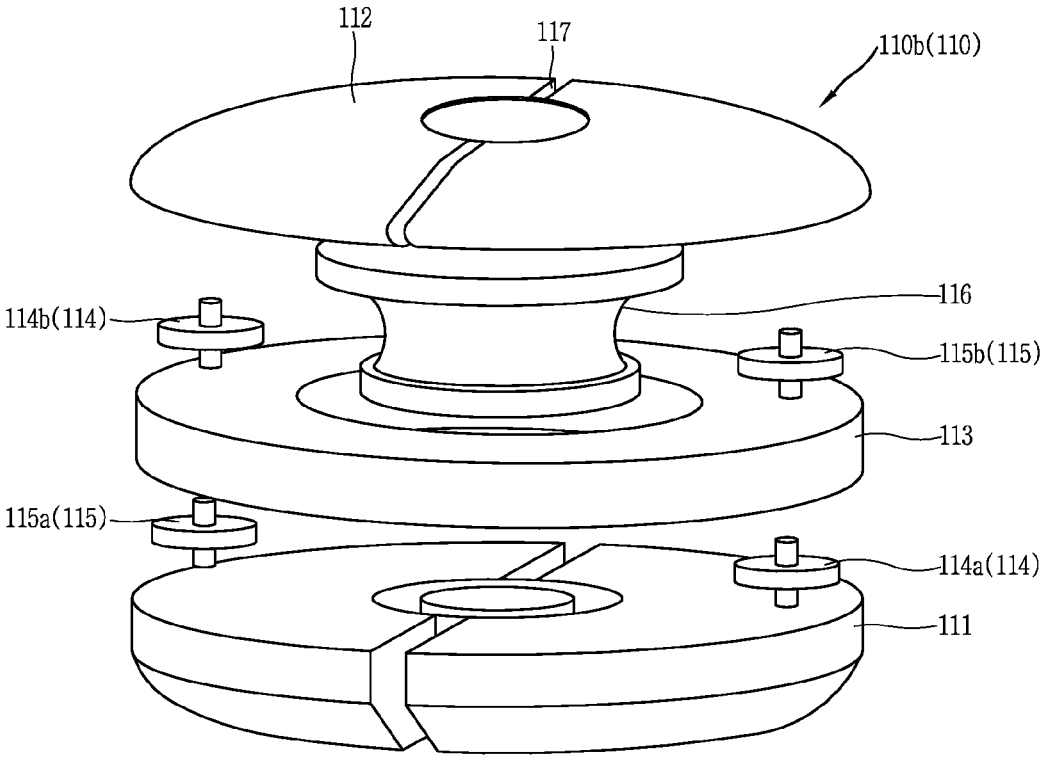
FIG. 6 is an exploded perspective view of an electrode assembly according to an embodiment of the present invention.
Figure 7:
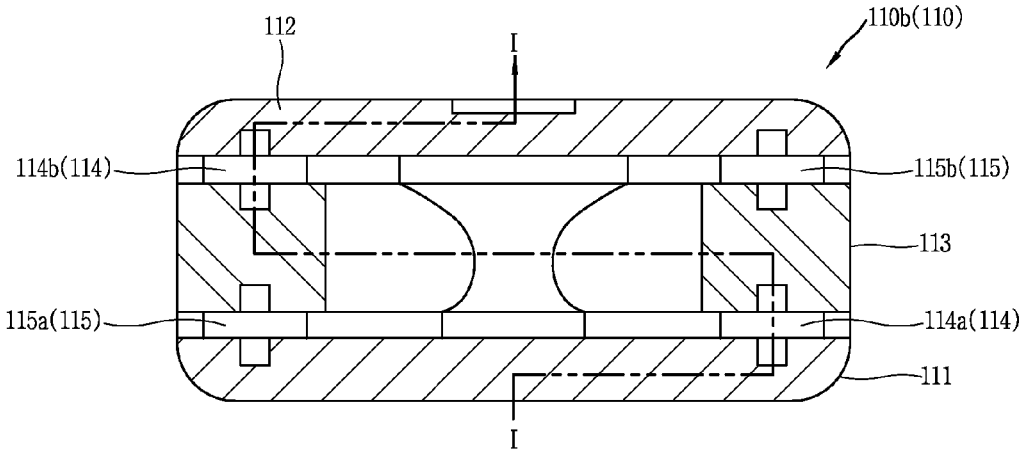
FIG. 7 is a cross-sectional view of the electrode assembly according to an embodiment of the present invention.

FIG. 6 is an exploded perspective view of the electrode assembly 110 according to an embodiment of the present invention, and FIG. 7 is a cross-sectional view of the electrode assembly 110 according to an embodiment of the present invention.

The present invention relates to a vacuum interrupter that is an essential element used in a vacuum circuit breaker.

The electrode assembly 110 includes a first electrode plate 111, a second electrode plate 112, a coil conductor 113, a conductor connecting pin 114, a supporting pin 115, and a metal structure 116.

The first electrode plate 111, the coil conductor 113, and the second electrode plate 112 may be conductors which are approximately discal in shape, and may be assembled to be stacked in the increasing order of distance from a fixing shaft or a movable shaft in an axial direction. To provide a description with reference to the drawing, the first electrode plate 111 may be disposed at a lower portion, the coil conductor 113 may be disposed at a middle portion, and a second electrode 112 may be disposed at an upper portion.

The first electrode plate 111 may be formed in a discal shape where one surface is formed to be rounded, and may be fixed to and disposed at the fixing shaft or the movable shaft. A receiving part may be formed in a groove shape, which is slightly recessed in a thickness direction, at a central portion of one surface of the first electrode plate 111. One end of the metal structure 116 may be disposed at the receiving part.

Moreover, the first electrode plate 111 may include a pair of slits 117. The slits 117 may be cut in a straight-line shape in a radius direction from a central portion of the first electrode plate 111. That is, when an eddy current generated by the first electrode plate 111 flows in a circumference direction through a radius-direction slit 117 (a cap which has a thin width and a long length) which is formed by cutting a portion of the first electrode plate 111, the slits 117 cuts off the flow of the eddy current, thereby preventing the eddy current from being generated.

The second electrode plate 112 fundamentally has the same structure and shape as those of the first electrode plate 111, and thus, its detailed description is not provided. The first electrode plate 111 may be connected to the fixing shaft or the movable shaft, and the second electrode plate 112 may be supported in a shape which is stacked on and coupled to the coil conductor 113. Also, the second electrode plate 112 may directly contact or may be separated from a second electrode plate 112 of a correspondent electrode assembly 110, and conducts or cuts off a current. In this case, the second electrode plate 112 is referred to as a contact electrode or a contact.

The coil conductor 113 may be formed in a one-body ring shape, and acts as a driving force of generating an axial magnetic field by allowing a current to flow in the circumference direction.

In particular, the coil conductor 113 may allow currents to flow in mutually opposite directions along the circumference direction from one side to the other side of a ring, thereby generating a bidirectional axial magnetic field. A description on the bidirectional axial magnetic field will be made below in detail along with a flow path of a current.

The conductor connecting pin 114 may include a first conductor connecting pin 114*a* and a second conductor connecting pin 114*b*. The first conductor connecting pin 114*a* may be formed of a conductive material between the first electrode plate 111 and the coil conductor 113, and the second conductor connecting pin 114*b* may be formed of a conductive material between the coil conductor 113 and the second electrode plate 112. Therefore, an electricity conducting path may be secured between the electrode plate and the coil conductor 113.

According to an embodiment, the first conductor connecting pin 114*a* may include a discal body, which has a relatively far smaller diameter than that of the electrode plate and a thickness which is thin compared to the diameter, and a supporting axial part which is formed to extend in an axial direction from central portions of one surface and the other surface of the discal body with the discal body therebetween. The first conductor connecting pin 114*a* may be fitting-coupled to the first electrode plate 111 and the coil conductor 113, and supported by the supporting axial part. Also, the first conductor connecting pin 114*a* may be disposed at a central side of an edge in the circumference direction when the first electrode plate 111 is divided by half by the slit 117.

The second conductor connecting pin 114*b* is formed in the same structure and shape as those of the first conductor connecting pin 114*a*, and has the same function as that of the first conductor connecting pin 114*a*. Thus, a description on the second conductor connecting pin 114*b* is not provided. The second conductor connecting pin 114*b* may be disposed on a plane, which differs from a plane of the first conductor connecting pine 114*a*, to be opposite to the first conductor connecting pin 114*a* with the coil conductor 113 therebetween.

For example, the first conductor connecting pin 114*a* may be disposed between the first electrode plate 111 and the coil conductor 113, and the second conductor connecting pin 114*b* may be disposed between the coil conductor 113 and the second electrode plate 112. The first and second conductor connecting pins 114*a* and 114*b* may be disposed on different planes with the coil conductor 113 therebetween to be opposite to each other with an interval of 180 degrees in the circumference direction.

The supporting pin 115 may include a first supporting pin 115*a* and a second supporting pin 115*b*. The first and second supporting pins 115*a* and 115*b* may be disposed between the electrode plate and the coil conductor 113, and may support the electrode plate and the coil conductor 113. In this case, a structure and shape of each of the first and second supporting pins 115*a* and 115*b* may be the same as those of the conductor connecting pin 114.

For example, the first supporting pin 115*a* may be disposed between the first electrode plate 111 and the coil conductor 113 to be opposite to the first conductor connecting pin 114*a* with an interval of 180 degrees in the circumference direction, and the second supporting pin 115*b* may be disposed between the coil conductor 113 and the second electrode plate 112 to be opposite to the second conductor connecting pin 114*b* with an interval of 180 degrees in the circumference direction. Therefore, the first and second supporting pins 115*a* and 115*b* may support the first electrode plate 111 and the coil conductor 113 so that a certain gap is maintained between the first electrode plate 111 and the coil conductor 113. In this case, the supporting pin 115 may be formed of an insulating material.

Here, the first and second conductor connecting pins 114*a* and 114*b* may be formed of, for example, copper. The first and second supporting pins 115*a* and 115*b* may be formed of a material having lower conductivity than that of copper. Therefore, a current flows to the first and second conductor connecting pins 114*a* and 114*b*.

The metal structure 116 may be disposed between the first electrode plate 111 and the second electrode plate 112 to pass through an internal hole of the coil conductor 113, may support the first electrode plate 111 and the second electrode plate 112, and may reinforce the inside of an electrode.

The metal structure 116 may include planar contact parts, which are respectively formed at one end and the other end of the metal structure 116 in an axial direction, and a middle side part which is concavely formed continuously along the circumference direction at a central portion between the contact parts to have a certain curvature. In this case, one of the contact parts may contact one surface of the first electrode 111 and support the first electrode 111, and the other may contact one surface of the second electrode 112 and support the second electrode 112. In particular, one end (a lower end in the drawing) of the metal structure 116 may have a relatively smaller diameter than that of the other end (an upper end in the drawing) of the metal structure 116, and thus, the metal structure 112 can better endure an impact which is applied when one of the second electrodes 112 contacts the other second electrode 112 which is a correspondent electrode.

A function of the electrode assembly 110 having the above-described structure and a flow path of a current therein will be described in detail.

In the vacuum interrupter, when the movable electrode assembly 110*b* is connected to a power source and the fixed electrode assembly 110*a* is connected to a load, a current flows in a direction from the movable electrode assembly 110*b* to the fixed electrode assembly 110*a*.

When the movable electrode assembly 110*b* is moved in the axial direction (i.e., an up direction) by an actuator (not shown) and inside the insulating vessel 101, contacts contact each other, and thus, a current flows. On the other hand, when the movable electrode assembly 110*b* is moved in a down direction, the contacts are separated from each other, and thus, the current is cut off.

In this case, when the contacts are separated from each other, namely, when the second electrode plate 112 of the movable electrode assembly 110*b* is separated from the second electrode plate 112 of the fixed electrode assembly 110*a*, metal arc vapor occurs between the contacts.

As described above, in a flat contact which any design is not reflected, an arc is contracted at a contact center due to a pin effect, and for this reason, an electrode surface is damaged by a concentration of the arc.

However, in the electrode structure according to an embodiment of the present invention, arcs are spread by an axial magnetic field, particularly, a bidirectional axial magnetic field, thereby enhancing arc extinction performance.

Figure 8:
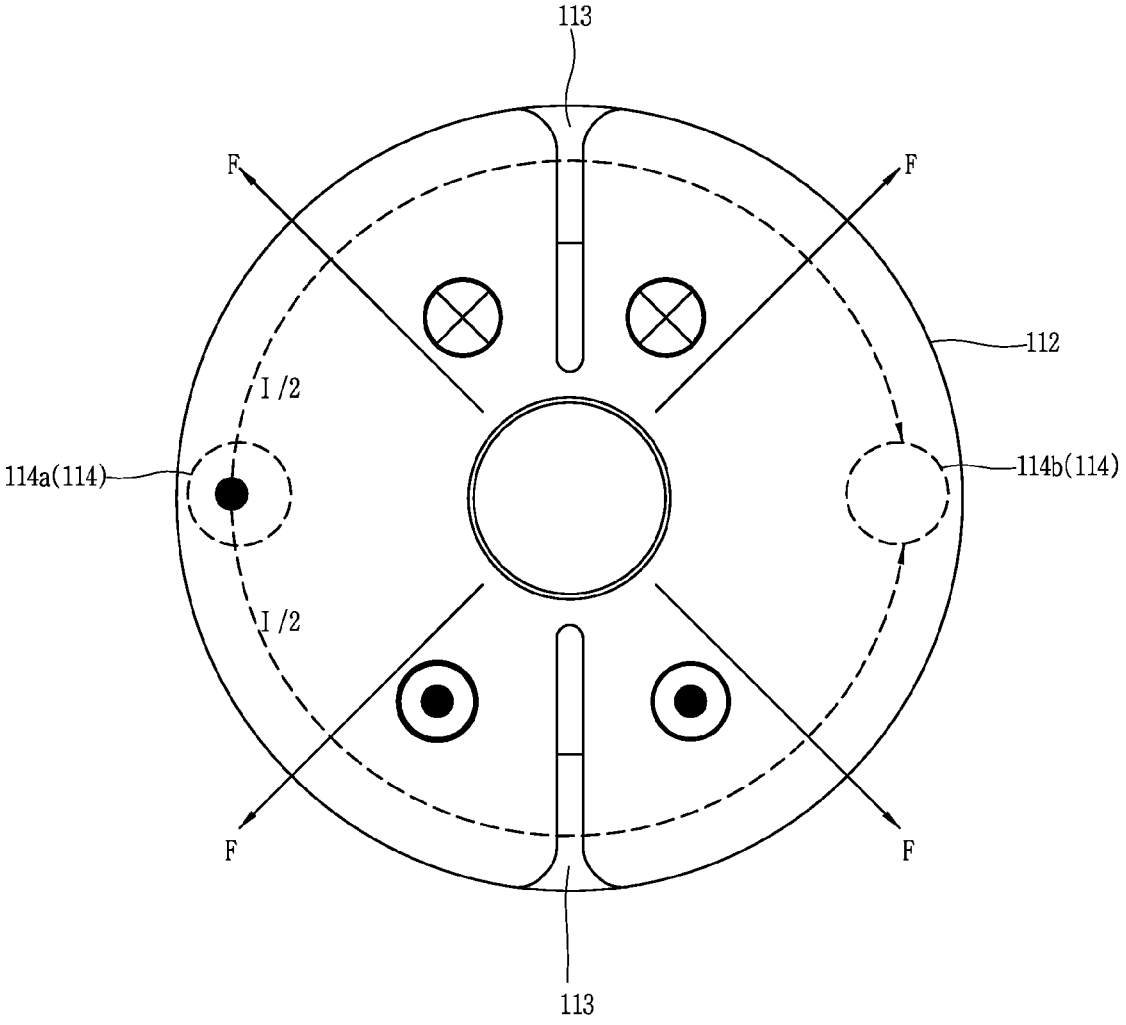
FIG. 8 is a plan view of the electrode assembly according to an embodiment of the present invention.

FIG. 8 is a plan view of the electrode assembly 110 according to an embodiment of the present invention.

First, a flow path of a current will be described in detail. Hereinafter, for understanding and convenience of description, the first electrode plate 111 is referred to as a supporting electrode plate 111, and the second electrode plate 112 is referred to as a contact electrode plate 112.

A current I flows into the supporting electrode plate 111 connected to the movable shaft, and the flowed current I flows into one side of the coil conductor 113 through the first conductor connecting pin 114*a*. In this case, the one side of the coil conductor 113 is a portion which directly contacts and is coupled to the first conductor connecting pin 114*a*.

The current I flowed into coil conductor 113 is divided by I/2 at the one side of the coil conductor 113, and then, the divided currents "I/2" rotate in mutually opposite directions along the circumference direction toward the second conductor connecting pin 114*b* which is disposed to be opposite to the first conductor connecting pin 114*a* with an interval of 180 degrees in the circumference direction, and join the other side of the coil conductor 113. In this case, the other side of the coil conductor 113 is a portion that directly contacts and is coupled to the second conductor connecting pin 114*b*.

Subsequently, the joined current I flows into a contact supporting plate through the second conductor connecting pin 114*b*, and flows from the contact supporting plate to a contact supporting plate of the fixed electrode assembly 110*a* that is a correspondent electrode. In the fixed electrode assembly 110*a*, the current flows in the reverse order of an electricity conducting path of the movable electrode assembly 110*b*.

Here, the currents "I/2" which rotate and flow in mutually opposite directions in the coil conductor 113 generate axial-direction magnetic fields in both directions.

That is, in a plan view as seen from above the coil conductor 113, one of two the currents "I/2" counterclockwise rotates to generate an axial-direction magnetic field in a direction (a bottom and up direction in a side view of the movable electrode assembly 110*b*) deviating from a paper surface, and the other current "I/2" clockwise rotates to generate an axial-direction magnetic field in a direction (a bottom and down direction in the side view of the movable electrode assembly 110*b*) entering into the paper surface, thereby generating a bidirectional axial magnetic field in the coil conductor 113.

When contacts are separated from each other due to occurrence of an abnormal current, arcs are generated between the contacts and concentrated on a specific position in a pillar shape at an initial stage of generation of the arcs. In this case, when the axial magnetic field is applied in the same direction (i.e., the axial direction) where an electron moves, the electron rotates to move in the axial direction. With the same principle, arcs generated between electrodes are spread to a whole surface of an electrode without being concentrated on a specific position.

Therefore, according to an embodiment of the present invention, arcs are spread by using the bidirectional axial magnetic field generated in the coil conductor 113, thereby enhancing arc extinction performance.

Moreover, in the prior art coil type axial magnetic field electrode structure, the coil conductor 113 is divided into two semicircular rings, the conductor connecting pin 114 and the supporting pin 115 are disposed with the coil conductor 113 therebetween, and two the conductor connecting pins 114 and two the supporting pins 115 are needed. For this reason, an electrode structure is complicated, and a process time and the cost increase. On the other hand, in the coil type axial magnetic field electrode structure according to an embodiment of the present invention, the coil conductor 113 is formed as one body in a circular ring shape, and one the conductor connecting pin 114 and one the supporting pin 115 are disposed with the coil conductor 113 therebetween. Accordingly, in comparison with the prior art coil type axial magnetic field electrode structure, the numbers of the conductor connecting pins 114, supporting pins 115, and coil conductors 113 are reduced by half, and thus, an electrode structure become simple, thereby reducing a process time and the cost.

Moreover, in the prior art unidirectional axial electrode structure, since an eddy current rotates by 360 degrees in the contact electrode plate 112, a plurality of the slits 117 (for example, four slits) for preventing the eddy current are needed, causing the increases in a process time and the cost. Also, dielectric strength is reduced due to a local concentration of an electric field caused by the shape of each of the slits 117. However, in the bidirectional axial magnetic field electrode structure according to an embodiment of the present invention, a plurality of the eddy currents rotate in mutually opposite directions in the contact electrode plate 112 without intersecting each other, and thus, the number of the slits 117 for cutting off a flow of the eddy current is reduced by two, thereby decreasing a process time and the cost.

Moreover, in comparison with the prior art unidirectional axial magnetic field, an effective area (which generally denotes an area having a size equal to or more than 4 mT/kA) enabling the spread of arcs to be effective is secured by using the bidirectional axial magnetic field, and thus, break performance can be enhanced. Also, since the number of the slits 117 is reduced by two in comparison with the prior art coil type axial magnetic electrode structure, an area which causes a local concentration of an electric field due to processing of the slits 117 is reduced, thereby enhancing dielectric strength.

As described above, in the vacuum interrupter according to the embodiments of the present invention, the bidirectional axial magnetic field is generated, and thus, the coil conductor is configured with one element. Accordingly, the electrode assembly structure is simplified in comparison with the prior art vacuum interrupter having a unidirectional axial magnetic electrode structure. Also, the number of the slits formed in the contact electrode is reduced, and thus, a process time and the cost are reduced.

Moreover, in comparison with the prior art unidirectional axial magnetic field, an effective cross-sectional area which affects the spread of arcs is enlarged, and thus, break performance can be enhanced. Also, the number of regions where a local concentration of an electric field caused by processing of a slit occurs is reduced, thereby enhancing dielectric strength.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. An electrode assembly comprises:

a first electrode plate;

a second electrode plate disposed to be separated from the first electrode plate in an axial direction;

a coil conductor disposed between the first electrode plate and the second electrode plate in a one-body ring shape;

a first conductor connecting pin connected to the first electrode plate at one side of the first conductor connecting pin, connected to the coil conductor at the other side of the first conductor connecting pin, and configured to provide an electricity conducting path; and a second conductor connecting pin connected to the coil conductor at one side of the second conductor connecting pin, connected to the second electrode plate at the other side of the second conductor connecting pin, and configured to provide an electricity conducting path; and a single piece metal structure disposed between the first electrode plate and the second electrode plate to pass through an internal hole of the coil conductor, the metal structure occupying an entire space of the internal hole, wherein the metal structure supports the first electrode plate and the second electrode plate, wherein the metal structure comprises:

a first contact part formed at one end of the metal structure, the first contact part contacting one surface of the first electrode;

a second contact part formed at the other end of the metal structure, the second contact part contacting one surface of the second electrode; and a middle portion connecting the first contact part and the second contact part, wherein the coil conductor induces a flow of a current in a first direction and a second direction between the other side of the first conductor connecting pin and the one side of the second conductor connecting pin, and the first direction and the second direction are mutually opposite circumference directions.

2. The electrode assembly of claim 1, further comprising:

a first supporting pin connected to the first electrode plate at one side of the first supporting pin, connected to the coil conductor at the other side of the first supporting pin, and configured to maintain a certain gap between the first electrode plate and the coil conductor; and a second supporting pin connected to the coil conductor at one side of the second supporting pin, connected to the second electrode plate at the other side of the second supporting pin, and configured to maintain a certain gap between the second electrode plate and the coil conductor.

3. The electrode assembly of claim 1, wherein the first electrode plate comprises a slit formed in a radius direction which crosses a flow of a current in a circumference direction.

4. The electrode assembly of claim 3, wherein the slit is formed in a straight line at both sides of the first electrode plate.

5. The electrode assembly of claim 1, wherein the second electrode plate comprises a slit formed in a direction which crosses a flow of a current in a circumference direction.

6. The electrode assembly of claim 5, wherein the slit is formed in a straight line at both sides of the second electrode plate.

7. The electrode assembly of claim 2, wherein the first conductor connecting pin and the second conductor connecting pin are formed of a material having relatively higher conductivity than the first supporting pin and the second supporting pin.

8. The electrode assembly of claim 1, wherein:

the first conductor connecting pin and the second conductor connecting pin are located at an outer periphery of the coil conductor;

the first conductor connecting pin and the second conductor connecting pin are located at different planes with respect to the coil conductor;

a current flowing in the coil conductor is divided into two currents at the other side of the first conductor connecting pin;

one of the two currents flows in a first direction and the other one of the two currents flows in a second direction; and the two currents join each other at the one side of the second conductor connecting pin, thereby generating a bidirectional axial magnetic field.

9. The electrode assembly of claim 2, wherein the first conductor connecting pin, the second conductor connecting pin, the first supporting pin, or the second supporting pin comprises a disc-shaped body and a supporting axial part formed to protrude in an axial direction from a central portion of the disc-shaped body.

10. The electrode assembly of claim 1, wherein:

the first electrode plate or the second electrode plate is formed in a disc shape; and a diameter of the second contact part is greater than a diameter of the first contact part.

11. A vacuum interrupter comprises:

a cylinder-shaped insulating vessel configured to include an accommodating space formed therein;

an internal shield provided at an inner surface of the insulating vessel, and configured to shield an arc gas which is generated in the insulating vessel;

a fixed electrode assembly supported by a fixing shaft to be fixed to one side of the insulating vessel; and a movable electrode assembly movably supported by a movable shaft and at the other side of the insulating vessel, wherein the fixed electrode assembly or the movable electrode assembly comprises:

a first electrode plate;

a second electrode plate disposed to be separated from the first electrode plate in an axial direction;

a coil conductor disposed between the first electrode plate and the second electrode plate in a one-body ring shape;

a first conductor connecting pin connected to the first electrode plate at one side of the first conductor connecting pin, connected to the coil conductor at the other side of the first conductor connecting pin, and configured to provide an electricity conducting path; and a second conductor connecting pin connected to the coil conductor at one side of the second conductor connecting pin, connected to the second electrode plate at the other side of the second conductor connecting pin, and configured to provide an electricity conducting path; and a single piece metal structure disposed between the first electrode plate and the second electrode plate to pass through an internal hole of the coil conductor, the metal structure occupying an entire space of the internal hole, wherein the metal structure supports the first electrode plate and the second electrode plate, wherein the metal structure comprises:

a first contact part formed at one end of the metal structure, the first contact part contacting one surface of the first electrode;

a second contact part formed at the other end of the metal structure, the second contact part contacting one surface of the second electrode; and a middle portion connecting the first contact part and the second contact part, wherein the coil conductor induces a flow of a current in a first direction and a second direction between the other side of the first conductor connecting pin and the one side of the second conductor connecting pin, and the first direction and the second direction are mutually opposite circumference directions.

12. The vacuum interrupter of claim 11, further comprising:

a first supporting pin connected to the first electrode plate at one side of the first supporting pin, connected to the coil conductor at the other side of the first supporting pin, and configured to maintain a certain gap between the first electrode plate and the coil conductor; and a second supporting pin connected to the coil conductor at one side of the second supporting pin, connected to the second electrode plate at the other side of the second supporting pin, and configured to maintain a certain gap between the second electrode plate and the coil conductor.

13. The vacuum interrupter of claim 11, wherein the first electrode plate comprises a slit formed in a radius direction which crosses a flow of a current in a circumference direction.

14. The vacuum interrupter of claim 13, wherein the slit is formed in a straight line at both sides of the first electrode plate.

15. The vacuum interrupter of claim 11, wherein the second electrode plate comprises a slit formed in a direction which crosses a flow of a current in a circumference direction.

16. The vacuum interrupter of claim 15, wherein the slit is formed in a straight line at both sides of the second electrode plate.

17. The vacuum interrupter of claim 12, wherein the first conductor connecting pin and the second conductor connecting pin are formed of a material having relatively higher conductivity than the first supporting pin and the second supporting pin.

18. The vacuum interrupter of claim 11, wherein:

the first conductor connecting pin and the second conductor connecting pin are located at an outer periphery of the coil conductor;

the first conductor connecting pin and the second conductor connecting pin are located at different planes with respect to the coil conductor;

a current flowing in the coil conductor is divided into two currents at the other side of the first conductor connecting pin;

one of the two currents flows in a first direction and the other one of the two currents flows in a second direction; and the two currents join each other at the one side of the second conductor connecting pin, thereby generating a bidirectional axial magnetic field.

19. The vacuum interrupter of claim 12, wherein one selected from the first conductor connecting pin, the second conductor connecting pin, the first supporting pin, or the second supporting pin comprises a disc-shaped body and a supporting axial part formed to protrude in an axial direction from a central portion of the disc-shaped body.

20. The vacuum interrupter of claim 11, wherein:

the first electrode plate or the second electrode plate is formed in a disc shape; and a diameter of the second contact part is greater than a diameter of the first contact part.

* * * * *